US008614552B2

(12) United States Patent
Campbell et al.

(10) Patent No.: US 8,614,552 B2
(45) Date of Patent: Dec. 24, 2013

(54) DETECTION OF THE POSITION OF AN ELV DIMMER FOR CONTROLLING OPERATION OF AN ISOLATED ELECTRICAL LOAD

(75) Inventors: Gregory Campbell, Walpole, MA (US); Joseph Michael DiBartolo, South Boston, MA (US)

(73) Assignee: Lumenpulse Lighting, Inc., Montreal, Quebec (CA)

( * ) Notice: Subject to any disclaimer, the term of this patent is extended or adjusted under 35 U.S.C. 154(b) by 0 days.

(21) Appl. No.: 13/345,079

(22) Filed: Jan. 6, 2012

(65) Prior Publication Data

US 2013/0175944 A1 Jul. 11, 2013

(51) Int. Cl.
*H05B 41/14* (2006.01)

(52) U.S. Cl.
USPC ..... 315/291; 315/294; 315/297; 315/312; 315/209 R

(58) Field of Classification Search
USPC ..... 315/291, 209 R, 294, 297
See application file for complete search history.

(56) References Cited

U.S. PATENT DOCUMENTS

| | | | | |
|---|---|---|---|---|
| 7,242,150 | B2 | 7/2007 | DeJonge et al. | |
| 7,511,628 | B2 | 3/2009 | Salvestrini | |
| 7,808,191 | B2 | 10/2010 | Wu | |
| 7,839,095 | B2 | 11/2010 | Ballenger et al. | |
| 7,888,886 | B2 | 2/2011 | Wu | |
| 2006/0082320 | A1 | 4/2006 | Ballenger et al. | |
| 2006/0255745 | A1* | 11/2006 | DeJonge et al. | 315/209 R |
| 2006/0255959 | A1 | 11/2006 | Salvestrini | |
| 2008/0093997 | A1* | 4/2008 | Chen et al. | 315/224 |
| 2008/0203934 | A1 | 8/2008 | Van Meurs | |
| 2008/0203940 | A1 | 8/2008 | Wu | |
| 2008/0246414 | A1 | 10/2008 | Xu et al. | |
| 2008/0252233 | A1 | 10/2008 | Wu | |
| 2009/0160358 | A1 | 6/2009 | Leiderman | |
| 2009/0200952 | A1 | 8/2009 | King | |
| 2009/0284182 | A1 | 11/2009 | Cencur | |
| 2010/0102753 | A1 | 4/2010 | Pilz | |
| 2010/0181935 | A1 | 7/2010 | Wu | |
| 2010/0289430 | A1 | 11/2010 | Stelzer et al. | |
| 2010/0301751 | A1 | 12/2010 | Chobot et al. | |
| 2011/0084623 | A1 | 4/2011 | Barrow | |
| 2011/0101877 | A1* | 5/2011 | Zhan et al. | 315/206 |
| 2011/0121754 | A1* | 5/2011 | Shteynberg et al. | 315/294 |
| 2011/0291583 | A1* | 12/2011 | Shen | 315/287 |
| 2012/0235585 | A1* | 9/2012 | Lys et al. | 315/200 R |
| 2012/0274216 | A1* | 11/2012 | Datta | 315/127 |
| 2012/0319608 | A1* | 12/2012 | Xu et al. | 315/208 |

* cited by examiner

*Primary Examiner* — Douglas W Owens
*Assistant Examiner* — Jonathan Cooper
(74) *Attorney, Agent, or Firm* — Pierce Atwood LLP; Joseph M. Maraia

(57) ABSTRACT

A system and process for controlling power delivered to an electrical load, such as lighting system, to controllably effect operation of the load (e.g., intensity of illumination). In at least some embodiments, the system and process interpret a user-adjustable setting of a typical electronic low voltage (ELV) dimmer control device that is otherwise isolated from facility AC power. An electrical stimulus, such as a relatively low power AC or DC voltage, is applied at one or more externally accessible terminals of the ELV dimmer control. An electrical response of the dimmer control to the stimulus is measured at one or more externally accessible terminals of the dimmer control. The electrical response varies according to the applied electrical stimulus and a user-adjustable setting of the dimmer control. An indication of the setting of the user-adjustable control is determined from the measured electrical response, and used to correspondingly dim a lighting source.

26 Claims, 10 Drawing Sheets

DETECTION OF THE POSITION OF AN ELV DIMMER FOR CONTROLLING OPERATION OF AN ISOLATED ELECTRICAL LOAD

BACKGROUND

1. Technical Field

This application relates generally to the field of lighting. More particularly, this application relates to the technology of controlling electrical loads, such as the intensity (i.e., dimming) of lighting sources.

2. Background Information

Presently, there are a variety of lighting sources in widespread commercial use. Some popular examples include incandescent, fluorescent, and solid state (e.g., light emitting diode (LED)) lighting sources. Even within certain lighting categories, there can be further distinctions, such as incandescent lighting operating at AC line-voltage levels (e.g., 120V, 60 Hz), or at DC low voltage (e.g., 6, 12, or 24 volts). Lighting sources operating at DC low voltages can be further distinguished into those using magnetic transformers and those using electronic (e.g., solid state) transformers. LED lighting sources typically require a matched LED driver, or power supply, providing the appropriate driving current and voltage levels dependent upon the nature of the LED lighting source.

In many lighting applications it is desirable to provide some measure of control to allow for variability of one or more attributes of the lighting source beyond simply "on" and "off" For example, a dimmer control can be provided to otherwise control the power delivered to the lighting source to achieve desired illumination intensity. Each type of lighting source (load types) has individual characteristics that generally require special types of dimmers. It is important to use a dimmer that is designed, tested, and UL listed for the specific lighting source/load type.

Dimmer controls can be user accessible, for example, as in wall switch styles providing a user adjustable control, such as a rotary knob, a sliding switch and electronically controllable switches (e.g., capacitively coupled). A user adjustment of the control is automatically converted by the dimmer into a corresponding power adjustment, for example, allowing a continuous adjustment of the resulting illumination from a maximum power (e.g., full on) to a minimum power (e.g., off). As a consequence of fundamental differences between the various lighting sources, a dimmer for one might not work with another. Thus, a dimmer control suitable for incandescent lighting may not be suitable for fluorescent or solid state lighting sources.

One such class of dimmer controls is referred to as electronic low voltage (ELV) dimmer controls. ELV dimmer controls are suitable for adjusting electrical power (e.g., average or RMS power) distributed to a low-voltage lighting source powered by electronic transformers, and therefore its light output, by effectively "chopping" the AC voltage waveform that is supplied to the lighting source as power. The particular chopping format used in ELV dimmers is commonly referred to as "trailing edge dimming" or "reverse-phase control." At its full brightness setting, the ELV dimmer control allows most, if not all, of the AC power waveform to pass through it, to power the light. As the dimmer control is adjusted to a dimmer setting, the second half period of each of the positive and negative portions of each AC power cycle is chopped by a value proportional to the position of an internal potentiometer. A dimmer setting results in a lower average (e.g., RMS) power over the period, resulting in corresponding reduction of illumination output. An example of such a chopped AC waveform is illustrated in FIG. 1.

A waveform of a typical AC power cycle is represented by a sine wave having a period T, (e.g., T=16.7 msec for a 60 Hz power). The period includes a positive half cycle and a negative half cycle. An example of a trailing edge chopping includes a sudden and precipitous change in the AC voltage to substantially zero volts, as shown by the vertical portions of the waveform occurring at $T/2-\tau$ and $T-\tau$. The AC voltage sine wave resumes upon each zero crossing until the next chopped portion, the pattern repeating for each AC cycle. Adjustment of the user adjustable control changes the position of the chopped portion (e.g., $\tau$), such that the resulting waveform has greater or lesser average power.

Unfortunately, such dimmers are generally not well suited for LED lighting sources. Such solid-state lighting applications generally include a power supply converting facility AC power to power suitable for the solid state lighting. In particular, for LED lighting the direction of current as well as its amplitude are controlled by such a power supply to provide desired illumination. As such, digital lighting applications are typically isolated from the AC mains by the presence of such a driving power supply. Accordingly, there is no assurance that providing an ELV chopped AC signal to a driving power supply associated with solid state lighting will result in the intended illumination setting, or dimming. In fact, there is no assurance that the solid state lighting will even operate as intended when powered by such a chopped AC waveform.

SUMMARY

It would be desirable to overcome the above mentioned shortcomings and drawbacks associated with the prior art.

Described herein are techniques for controlling power delivered to a lighting system in order to control the intensity of illumination of the lighting system. In particular, techniques are described herein for enabling various lighting systems to use ELV dimmers as a source of input for dimming solid state or traditional sources, without the typical negative effects often associated with the use of an ELV dimmer provided in combination with (e.g., series) such lighting arrangements. Low-power, low-voltage devices and processes are described for sampling an ELV dimmer's position, such that ELV dimmer can be utilized in systems with high voltage power signals, and without regard to the controlled lighting technology.

In one aspect, at least one embodiment described herein provides a process for dimming a light. The process includes applying an electrical stimulus at a first externally accessible terminal of a dimmer device. The dimmer device has a user-adjustable control that is settable between low and high dimmer settings. An electrical response is measured at a second externally accessible terminal of the dimmer device. The electrical response is responsive to the applied electrical stimulus and a setting of the user-adjustable control. An indication of the setting of the user-adjustable control is determined from the measured electrical response, and a light source is dimmed responsive to the determined dimmer device setting.

In another aspect, at least one embodiment described herein provides a system for dimming a light. The system includes an electrical power converter that is adapted for converting an AC line voltage to a preferred electrical stimulus. The preferred electrical stimulus is suitable for driving at least one externally accessible terminal of a dimmer control device having a user-adjustable control input settable between low and high dimmer settings. The system further includes an electrical signal detector adapted for measuring at an externally accessible terminal of the dimmer control device, an electrical response of the dimmer control device to the preferred electrical stimulus. The electrical response is indicative of a setting of the user adjustable control input. A signal converter is provided in electrical communication with the electrical signal detector. The signal converter is adapted for converting the measured electrical response to a dimmer control signal indicative of the setting of the user adjustable control input.

In yet another aspect, at least one embodiment described herein provides a system for detecting a setting of a line voltage dimmable controller. The system includes means for applying an electrical stimulus at a first externally accessible terminal of a dimmer device. The dimmer device has a user-adjustable control settable between low and high dimmer settings. The system also includes means for measuring an electrical response at a second externally accessible terminal of the dimmer device. The electrical response is responsive to the applied electrical stimulus and a setting of the user-adjustable control. Means for determining from the measured electrical response an indication of the setting of the user-adjustable control are also provided, as are means for dimming a light source responsive to the determined dimmer device setting.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DESCRIPTION OF THE PREFERRED EMBODIMENTS

In the following detailed description of the preferred embodiments, reference is made to accompanying drawings, which form a part thereof, and within which are shown by way of illustration, specific embodiments, by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the case of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in that how the several forms of the present invention may be embodied in practice. Further, like reference numbers and designations in the various drawings indicate like elements.

Figure 2:
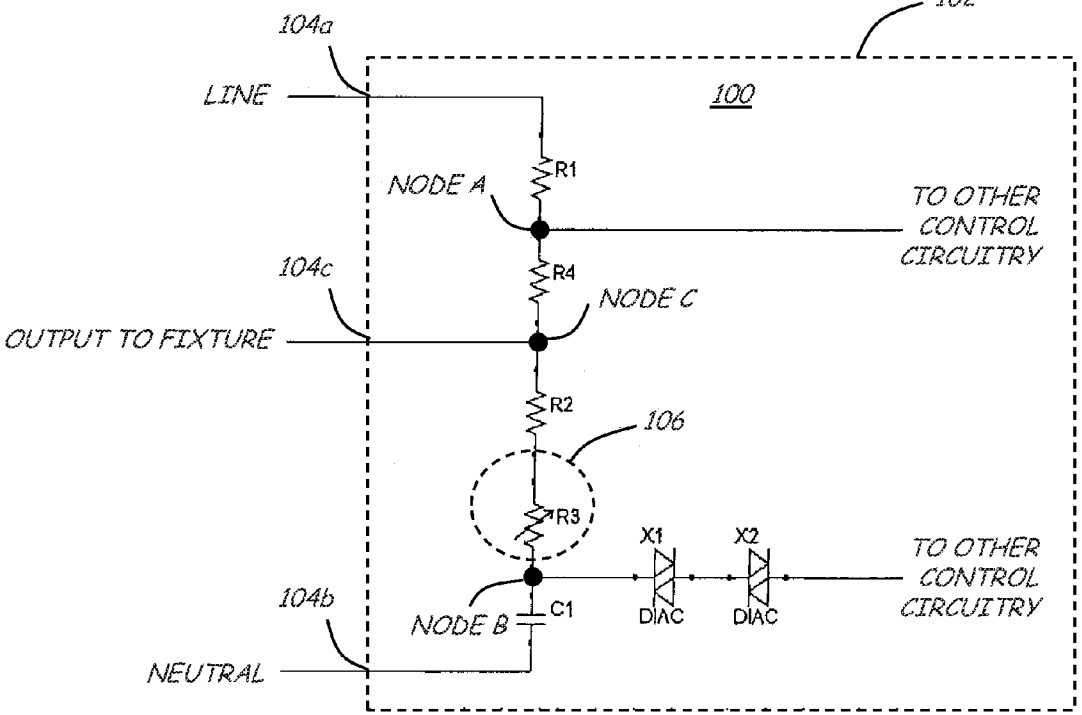
PRIOR ART FIG. 2
FIG. 2 is a block diagram of an embodiment of an ELV dimmer circuit.

FIG. 2 depicts an electronic circuit schematic of an example of an ELV dimmer control 100. The dimmer control 100 includes a housing 102, with at least three externally accessible ports or terminals 104*a*, 104*b*, 104*c* (generally 104). The housing 102 can conform to that of a typical single or multi-gang electrical switch, suitable for installation within a standard electrical box. A first externally accessible terminal 104*a* is intended under normal operation for connecting to a power line, such as a 120 Volt, 60 Hz AC power line (e.g., LINE). A second externally accessible terminal 104*b* is intended under normal operation for connecting to a power line neutral (e.g., NEUTRAL), and a third externally accessible terminal 104*c* is intended under normal operation for connecting to a controlled device (e.g., OUTPUT TO FIXTURE). The ELV dimmer control 100 also includes at least one user adjustable control 106, such as a knob, a dial, a slideable switch, or the like. In an intended mode of operation, the typical ELV dimmer control 100 receives facility AC power input by way of the LINE and NEUTRAL terminals 104*a*, 104*b*.

The example dimmer control 100 includes three fixed-value resistors R1, R2, R4, one potentiometer R3, and one capacitor C1 connected in series between the LINE and NEUTRAL terminals 104*a*, 104*b*. In particular, resistors R1 and R4 are coupled between the LINE and OUTPUT TO FIXTURE terminals 104*a*, 104*c*, while resistor R2, potentiometer R3 and capacitor C1 are coupled between the OUTPUT TO FIXTURE and NEUTRAL terminals 104*c*, 104*b*. A first internal node, NODE A, is provided between resistors R1 and R4, with an electrical interconnect to other internal control circuitry of the dimmer control 100 (not shown). Likewise, second internal node, NODE B, is provided between resistor R3 and capacitor C1, with an electrical interconnect to other internal control circuitry of the dimmer control 100 (not shown). In the example circuit, two diodes for alternating current (DIAC) X1, X2 are coupled in series between NODE B and the other internal control circuitry. Such DIAC devices X1, X2 conduct current only after a breakover voltage has been reached momentarily.

Figure 3:
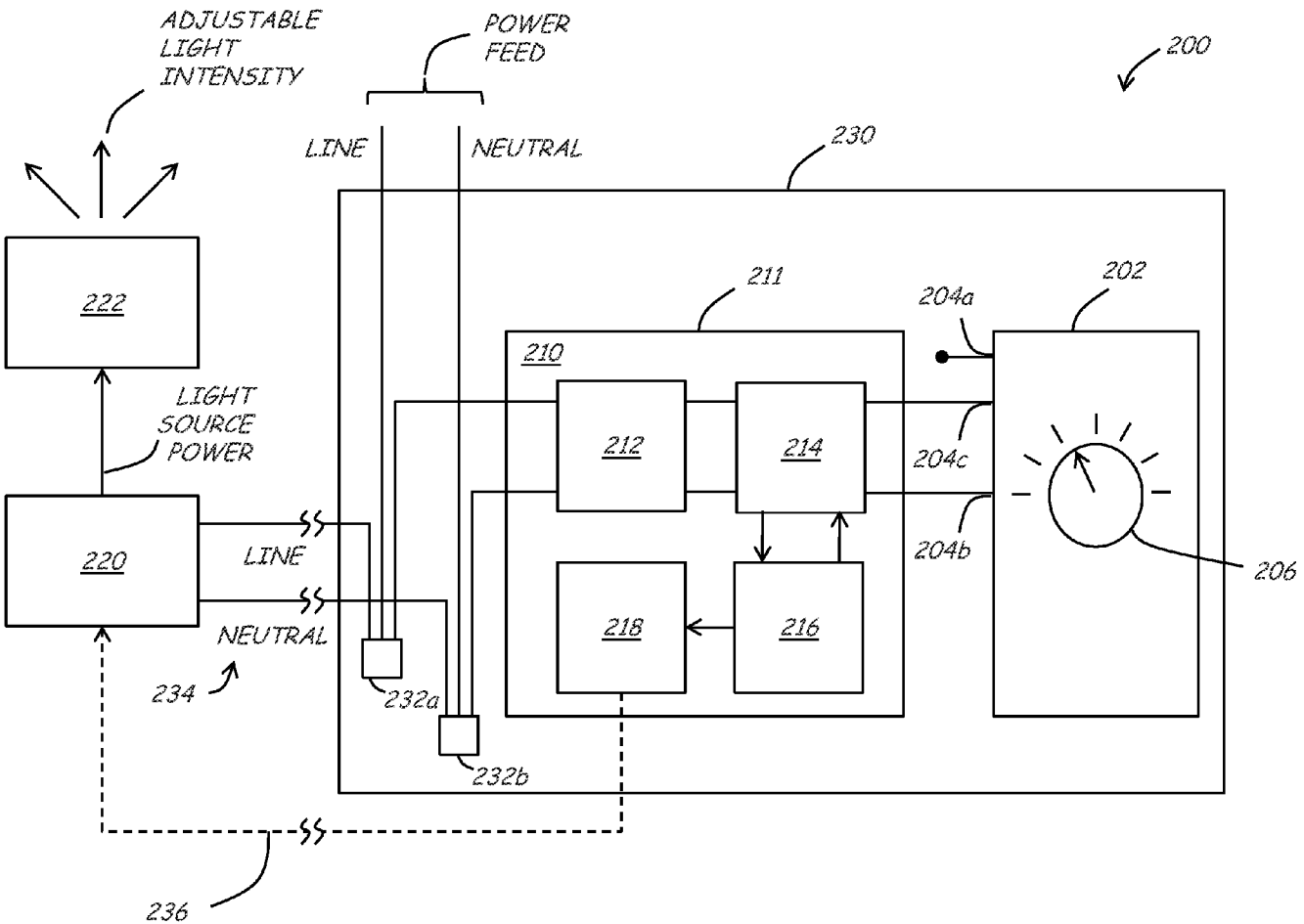
FIG. 3 is a functional block diagram of system for determining a setting of a dimmer control and dimming a light source responsive to the determined setting.

A functional block diagram of system 200 for determining a setting of a dimmer control and dimming a light source responsive to the determined setting is shown in FIG. 3. An ELV dimmer control 202, such as described above, includes three externally accessible terminals: LINE 204*a*, NEUTRAL 204*b* and OUTPUT TO FIXTURE 204*c*, and a user adjustable control 206. The system 200 also includes an ELV dimmer adapter 210 coupled between the ELV dimmer control 202 and an adjustable power supply 220, for example, adapted to drive a solid-state (i.e., LED) lighting source 222.

In the illustrative example, the ELV dimmer adapter 210 and the adjustable power supply 220 receive facility AC power (i.e., LINE and NEUTRAL), whereas the ELV dimmer control 202 does not.

In accordance with the techniques described herein, the ELV dimmer adapter 210 receives AC power and converts the AC power to a lower-valued, test voltage. The ELV dimmer control 202 is not connected directly to facility AC power as would otherwise be done under normal operations. Rather, the lower-valued test voltage provides an electrical stimulus to the ELV dimmer control 202, applied to at least one of terminal 204*c* and terminal 204*b* (e.g., between the terminals), while the LINE terminal 204*a* is left open circuit, or otherwise unconnected.

In more detail, the ELV dimmer adapter 210 includes an internal power supply and/or power converter 212 that converts AC line power to a suitable test voltage. In at least some embodiments, the adapter 210 also includes a detector 214, a processor 216 and a communications interface 218. The detector 214 is coupled to one or more of the OUTPUT TO FIXTURE and NEUTRAL terminals 204*c*, 204*b*. The detector 214 is configured to measure an electrical response at one or more of the first and second externally accessible terminals 204*b*, 204*c* of the dimmer device. The measured electrical response is responsive to the applied test voltage and a setting of the user-adjustable control 206. The processor 216 is in electrical communication with the detector 214, such that the processor 216 receives an indication of the measured electrical response. The processor 216 is configured to determine from the measured electrical response an indication of the setting of the user-adjustable control 206. The processor 216 is further in communication with the communications interface 218, which is configured to convey an indication of the dimmer setting to the adjustable power supply 220. The adjustable power supply 220, in turn, adjusts an intensity of illumination provided by the LED lighting source 222 by an amount corresponding to the user adjustable setting 206. Thus, ELV dimmers can be used for controlling power delivered to solid-state as well as traditional lighting systems in order to control the intensity of illumination, without regard to the otherwise negative impacts of chopped AC waveforms typically provided by such dimmers.

In at least some embodiments, the ELV dimmer adapter 210 is also accommodated within a housing 211 that conforms to a typical single or multi-gang electrical switch. Accordingly, in at least some embodiments, such an ELV dimmer adapter 210 can be installed together with an ELV dimmer control 202, within a common multi-gang standard electrical box 230. The box 230 can be fed by an AC power feed or circuit, which can be split within the box 230 (e.g., using wire connectors 232*a*, 232*b*) to power the ELV dimmer adapter 211 and to a second set of electrical conductors 234 providing AC facility power to the adjustable power supply 220. The communications interface 218 can be configured to convey an indication of the dimmer setting to the adjustable power supply 220 by any suitable means. Examples include one or more dedicated lines (e.g., electrical conductors, optical fibers) 236 (shown in phantom), wirelessly and over available electrical conductors, such as the AC conductors 234, by using a suitable power line communications (PLC) protocol.

Figure 4:
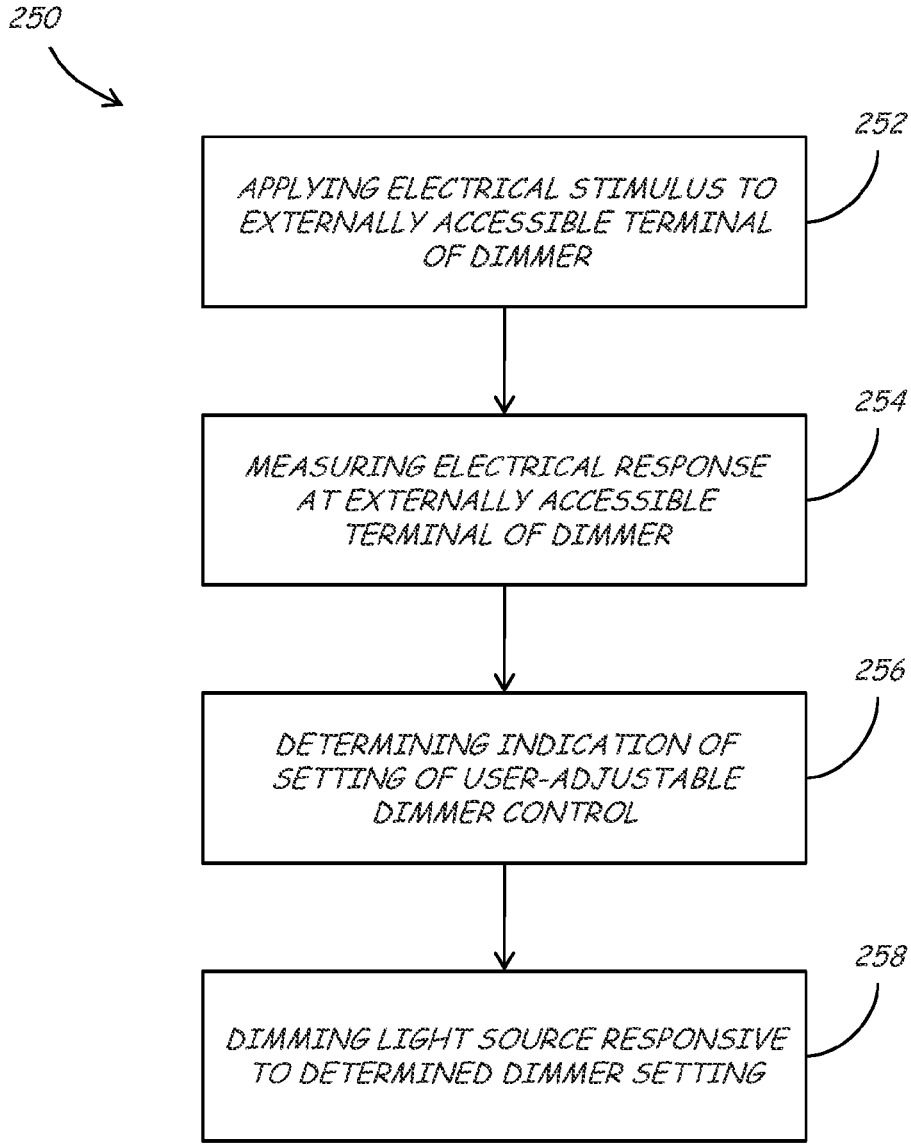
FIG. 4 is a flow diagram of an embodiment of a process for determining a setting of a dimmer control and dimming a light source responsive to the determined setting.

FIG. 4 is a flow diagram of an embodiment of a process 250 for determining a setting of a dimmer control and dimming a light source in response to the determined control setting. In particular, a typical ELV dimmer control can be used as a human interface for adjusting intensity of an LED lighting source. In a significant departure from a typical installation, however, the ELV dimmer is not directly connected to facility AC power. In fact, in at least some embodiments, an AC line input terminal is left open or otherwise disconnected. Rather, an electrical stimulus, such as a relatively low AC or DC voltage, is applied to one or more of first and second externally accessible terminals of the dimmer control. The process includes measuring at one or more of the first and second externally accessible terminals, an electrical response of the dimmer control at 254. An indication of setting of the user-adjustable dimmer control is determined at 256. Such a determination can include a voltage level, such as an average AC voltage, a DC representation of the AC voltage, or a time value associated with a voltage transient. Any such value indicative of the determined setting can be used to dim a light source at 258.

Figure 5:
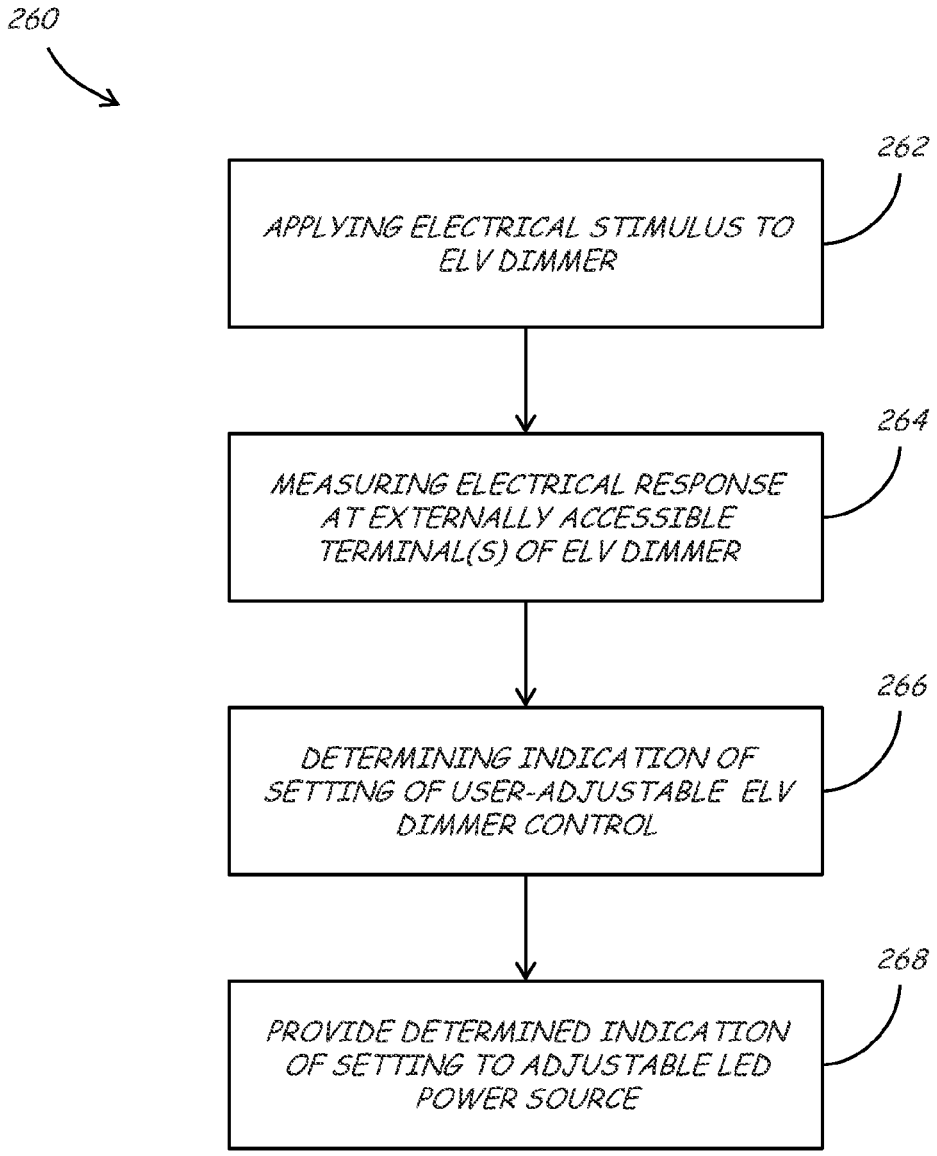
FIG. 5 is a flow diagram of another embodiment of a process for determining a setting of a dimmer control and providing an indication of the determined setting to an adjustable LED power source.

Another embodiment of a process 260 for determining a setting of a dimmer control and for providing an indication of the determined setting to an adjustable LED power source is illustrated in FIG. 5. Once again, a typical ELV dimmer control can be used as a human interface for dimming an LED lighting source. Similarly to the previous embodiment, the ELV dimmer control is not directly coupled to facility AC power, as it would be in a typical installation. The process includes applying electrical stimulus to an externally accessible terminal of the typical ELV dimmer at 262. An electrical response is measured at externally accessible terminal(s) of ELV dimmer at 264. An indication of a setting of user-adjustable ELV dimmer control is determined at 266, and the LED lighting source is dimmed in accordance with the determined setting at 268.

Sensing Via AC Input

Figure 1:
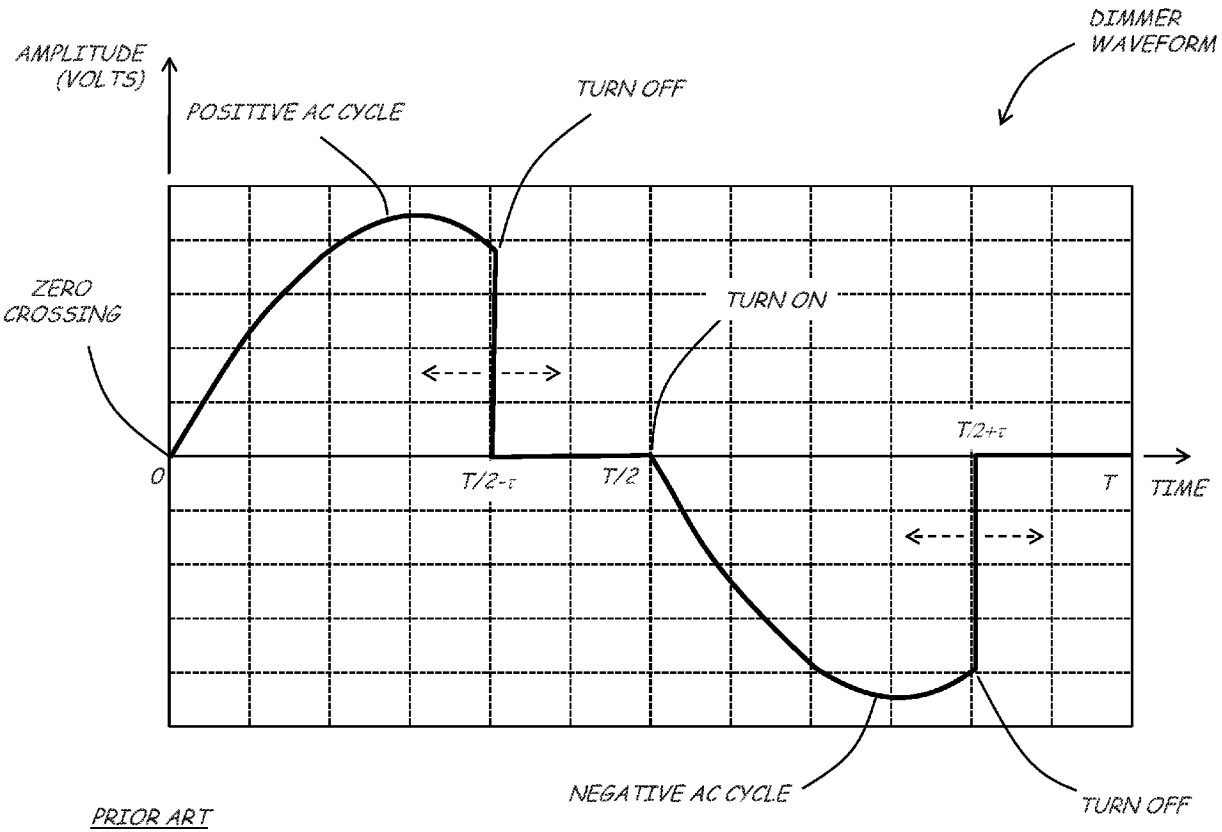
FIG. 1 PRIOR ART
FIG. 1 is a graph of an example of a chopped AC waveform produced by an ELV dimmer control under normal operation.

Referring again to FIG. 2, under normal operation, the series combination of all resistances R1-R4 and the capacitor C1 form a low pass filter that drives other control circuitry of the ELV dimmer control 100. Beneficially, the two DIAC devices X1, X2 allow such other circuitry to be essentially ignored at low voltage levels, because the DIAC devices X1, X2 present a high impedance to the timing circuit when their breakover voltage has not been exceeded (e.g., at low levels). Such a breakover voltage level may vary, depending upon the particular device, or device-to-device variations, but it is generally above about 30 volts, a value much higher than many microcontroller-based systems require. The circuitry above NODE C (FIG. 1) may also be ignored if the LINE terminal 104*a* is left open or otherwise unconnected and the particular topology insures that there is a high impedance between the top "To other control circuitry" and the NEUTRAL terminal 104*b*. A goal is to sense the position of the potentiometer R3 of the ELV dimmer control 100 with sufficient specificity, in order to dim an external light source, such as a digitally controlled light source, as if the ELV dimmer control 100 were directly affecting the light output of the external light source. There are various solutions to this problem, such as the illustrative embodiments described below.

Given the available externally accessible terminals 104, a relatively low AC test voltage (e.g., less than 30 volts-peak) can be applied to one or more of (e.g., between) terminals 104*c* and 104*b*. The frequency of the applied AC voltage can be chosen based on the values of the components, and in particular the value of the capacitor C1. For example, a frequency can be chosen such that the impedance of capacitor C1 is substantially negligible in comparison to that of resistor R2. Accordingly, it is possible to interconnect an external resistor network (e.g., within the ELV adapter 210) to the NEUTRAL terminal 104*b*, in order to sense the position of the potentiometer R3. Since C1 resembles or otherwise approximates a short circuit at such high frequencies, the AC test voltage applied between terminals 104*c* and 104*b* will vary at the output of the resistor network according to the potentiometer R3 setting, and likewise with the position of the user-adjustable control 106.

Figure 6A:
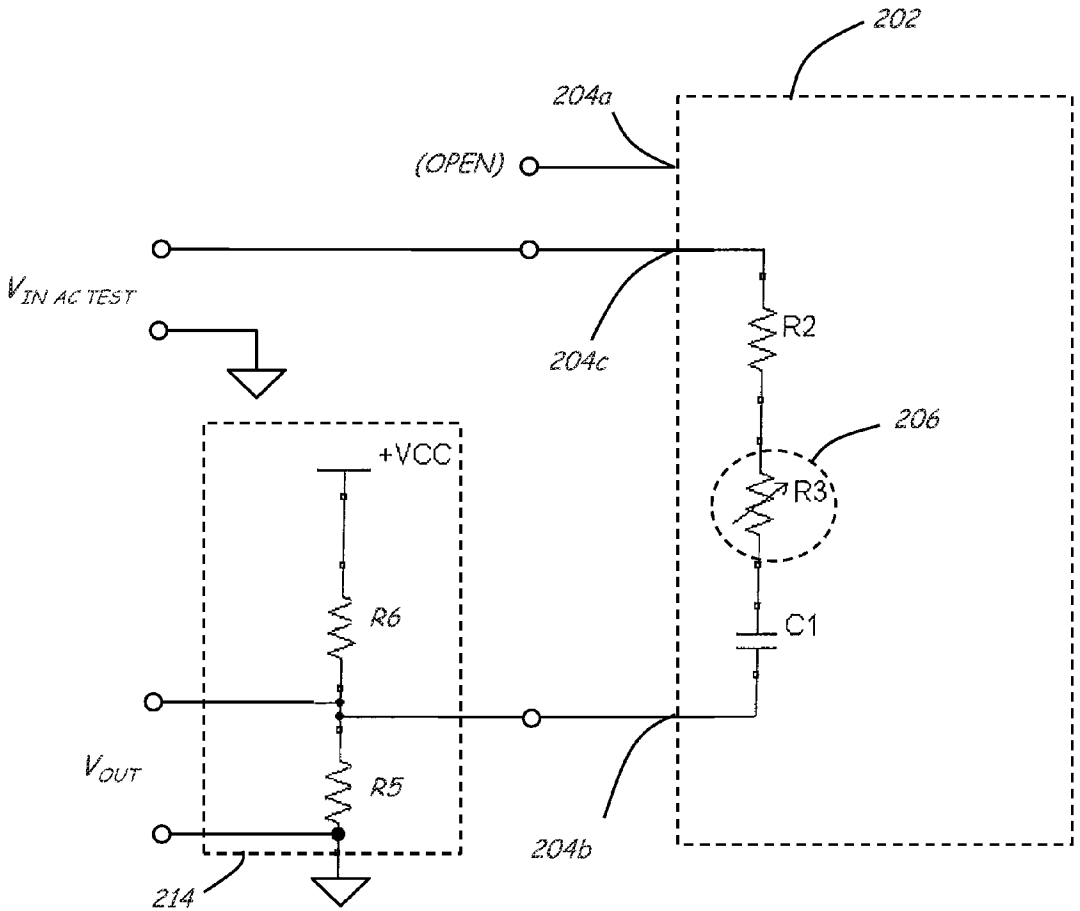
FIG. 6A is a circuit diagram of an embodiment of a detector configured for determining a setting of a dimmer control in response to AC stimulus.

In at least some embodiments, the test voltage can be AC coupled, such that any DC offset of the test voltage at the input results in a detected voltage that varies by the same amplitude around zero volts, being negative for part of its period. In at least some embodiments, detecting AC coupled signal can be compensated for by using a biasing network, such as the resistor biasing network as shown in FIG. 6A. Resistance values of resistors R5 and R6 can be chosen based on the resistance values of the potentiometer R3 and resistor R2, so that significant voltage amplitude will be present at the output. A DC offset can be determined as the product of a biasing voltage VCC and the resistor combination of R5/(R5+R6). Likewise, assuming $V_{IN\ AC\ TEST}$ is AC coupled (e.g., centered about zero volts), $V_{OUT}$ can be determined as set forth below in Eqn. 1, in which the quantity R5||R6, represents a parallel combination of resistors R5 and R6, i.e., R5R6/(R5+R6).

$$V_{OUT} = V_{IN\ AC\ TEST} \cdot \frac{(R2 + R3)}{(R2 + R3 + (R5 \| R6))} + V_{CC} \cdot \frac{R5}{(R5 + R6)} \qquad \text{Eqn. 1}$$

With all other values fixed, the output voltage $V_{OUT}$ varies according to the resistance value of the potentiometer R3, and likewise according the setting of the user-adjustable control 206 (FIG. 2). In the example embodiment, one or more of the test voltage and the biasing voltages can be supplied by the power supply 212 of the ELV adapter 210 (FIG. 3).

In at least some embodiments, the output voltage representing a detected output can be converted, for example, to a digital value for interpretation by the processor 216. For example, the processor 216 can translate the detected output voltage to a control value according to a function, such as a predetermined lookup table. Alternatively or in addition, the output voltage can be used to directly drive the communications interface 218 for controlling the adjustable power supply 220 of the dimmable illumination source 222.

Figure 6B:
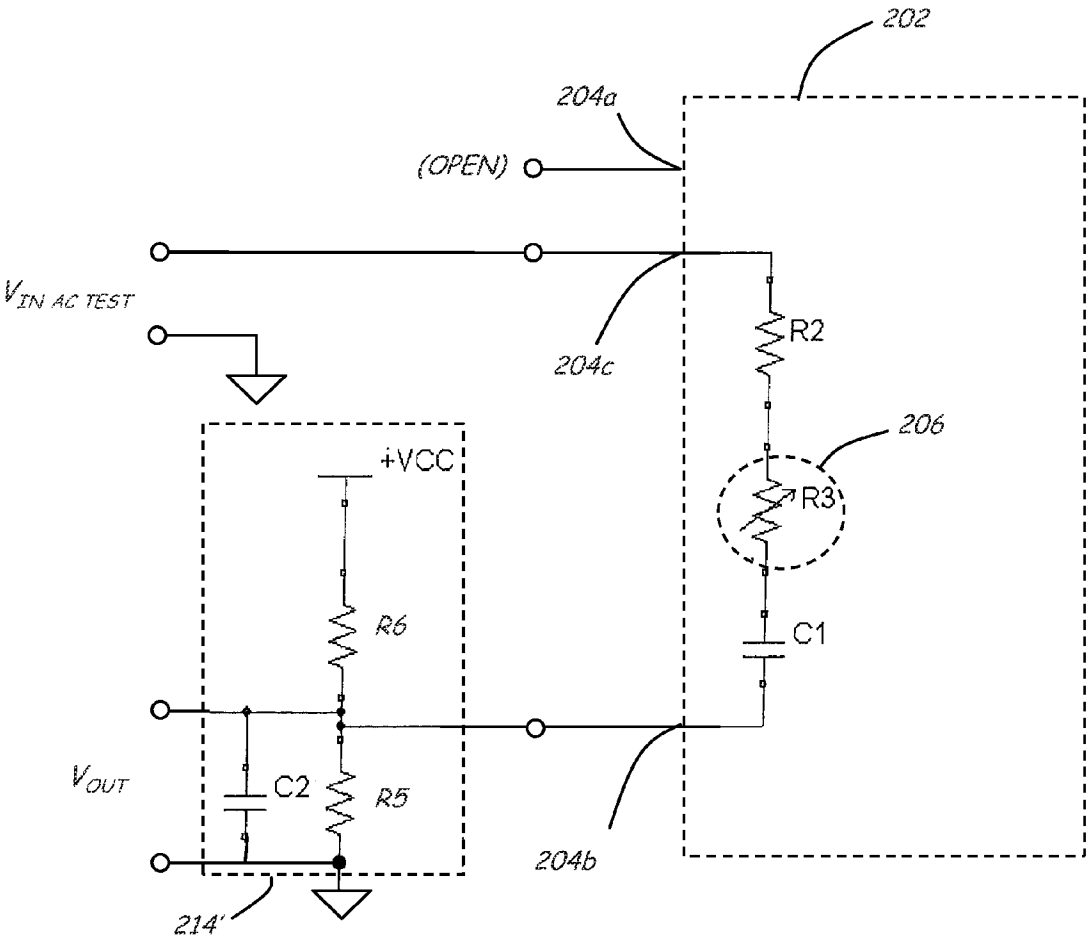
FIG. 6B is a circuit diagram of another embodiment of a detector configured for determining a setting of a dimmer control in response to AC stimulus.

In some embodiments, the output voltage of the detector $V_{OUT}$ is converted or otherwise approximated by a DC voltage. For example, such a DC output voltage indicative of the detected AC signal can be converted to a digital value according to an analog-to-digital converter (ADC). Referring to FIG. 6B, a modified detector 214' includes a capacitor C2 added to the biasing circuit of the previously described detector 214. For example, the capacitor C2 can be added in a parallel arrangement with the second biasing resistor R5. The R-C combination forms a low-pass filter for the output signal $V_{OUT}$, approximating it by a substantially DC value. In such applications, the capacitor C2 should be significantly larger than capacitor C1.

Figure 6C:
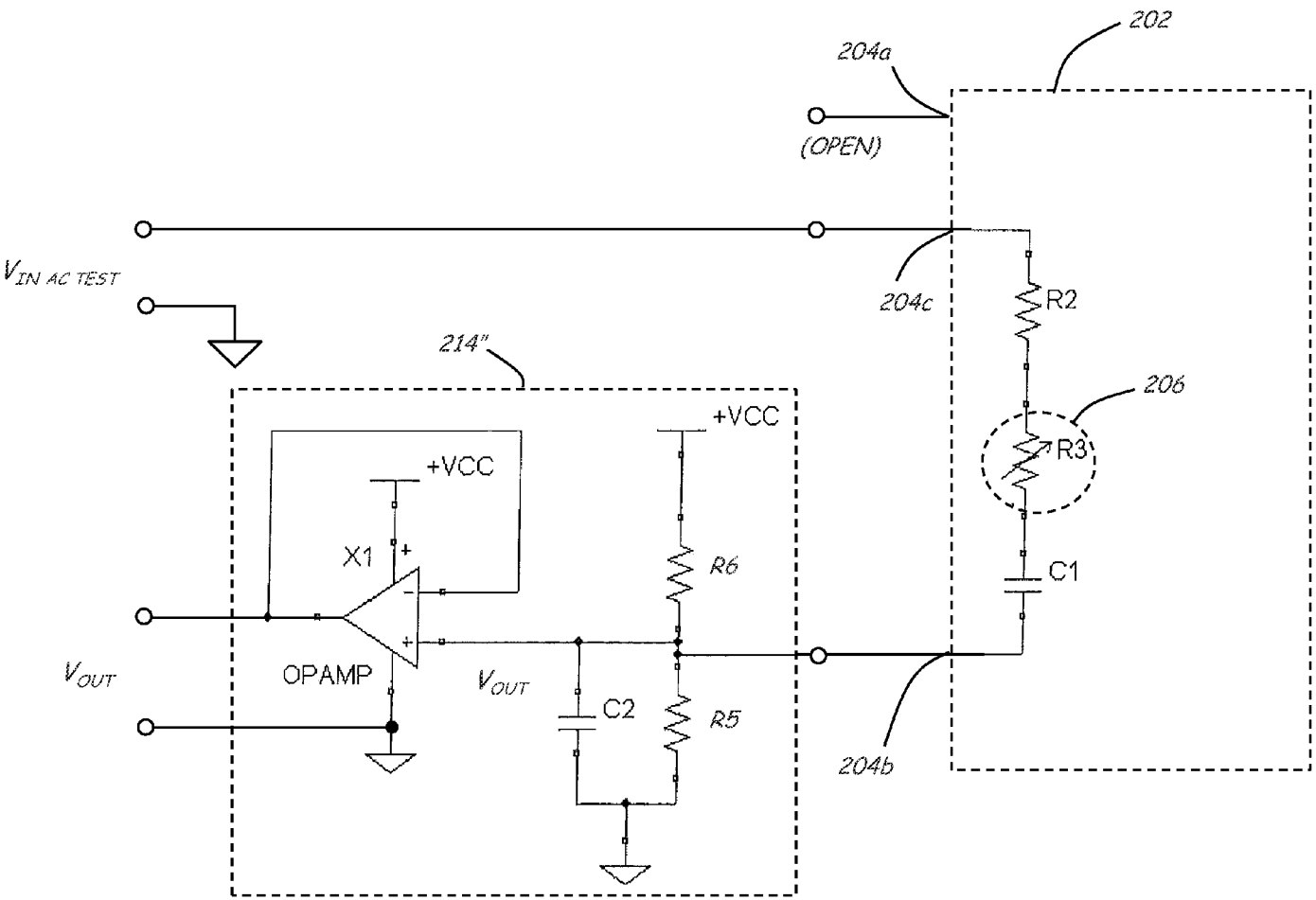
FIG. 6C is a circuit diagram of yet another embodiment of a detector configured for determining a setting of a dimmer control in response to AC stimulus.

In at least some embodiments, the resistance values in the circuit are most likely high in value (e.g., 10 kΩ or higher). For embodiments in which ADC sample speeds are to be kept high, a voltage follower circuit can be added to provide a higher current drive without affecting the amplitude. An example of another detector 214" illustrated in FIG. 6C, includes a voltage follower. The circuit is essentially the same as illustrated in FIG. 6B, except that a voltage follower circuit is added to the output of the filtered biasing network (i.e., resistors R5, R6 and capacitor C2). In the illustrative embodiment, the voltage follower is provided by an operational amplifier X1, configured to provide unity gain, as shown, with its non-inverting input coupled to the filtered biasing network.

Figure 7:
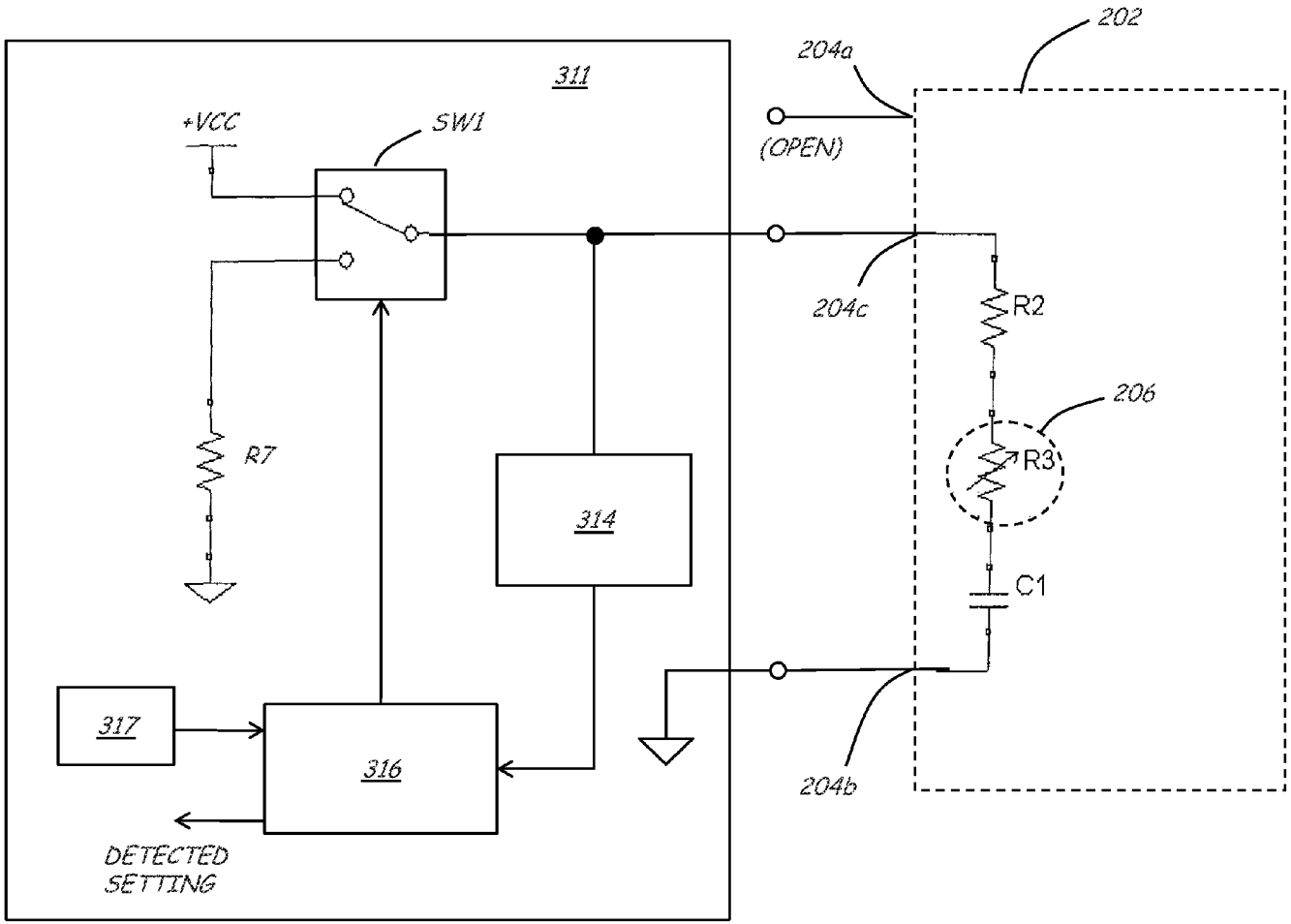
FIG. 7 is a circuit diagram of an embodiment of a detector configured for determining a setting of a dimmer control in response to DC stimulus.

Sensing Via DC Input:

An alternate method for determining the position of the user-adjustable control 206 (i.e., the potentiometer R3) is to apply a DC voltage (e.g., VCC) at terminal 204*c* (or between terminal 204*c* and terminal 204*b*), while terminal 204*a* is left open or otherwise unconnected. Referring next to FIG. 7, in at least some embodiments, VCC is provided by a power supply provided within an ELV adapter 311. Thus, in at least some embodiments VCC can be derived from AC facility power. The DC voltage VCC is applied to one terminal of a single-pole-double-throw switch SW1. Another terminal of the switch SW1 is coupled to ground through a load resistor R7. In operation, the switch SW1 initially connects the DC voltage to terminal 204*c* for a sufficient duration of time to charge the internal capacitor C1 of the ELV dimmer control 202 to a full DC voltage through resistors R2 and R3. The switch SW1 can be controlled, for example, by a processor 316 to switch the terminal 204*c* from the DC voltage to the load resistor R7. When so configured, the previously charged capacitor C1 is discharged through the load resistor R7 (or more appropriately, through the combination of resistors R2, R3 and R7).

With all of the other resistance values constant (i.e., R2 and R7), the time taken to discharge the capacitor C1 is proportional to the value of potentiometer R3. The discharge time can be sensed using a detector 314, alone or in combination with a microcontroller (e.g., processor 316). The detector can include, for example, a voltage level detecting circuit, such as a comparator, to detect a voltage at terminal 204*c* above or below a threshold voltage.

In measuring such intervals of time, the ELV adapter 311 can include a timing reference 317. In some embodiments, the timing reference 317 can be provided by a digital timing circuit, such as a resettable counter driven by a reliable clock source. Alternatively or in addition, the timing reference 317 can be received from an external timing source. Thus, the processor can measure a period of time from the command to discharge the capacitor (e.g., switch terminal 204*c* from VCC to resistor R7) to when the voltage at terminal 204*c* falls below a predetermined discharge value. In at least some embodiments, the detector 314 and processor 316 also cooperate to determine when the capacitor C1 is sufficiently charged. This can be accomplished, for example, by monitoring the voltage at terminal 204*c*.

Having determined the discharge time interval, the position of the potentiometer R3 (and hence the user-adjustable setting 206) can be inferred. For example, the detected time can be determined by the processor 316, which converts the measured time interval to a dimmer control setting according to a function, such as a lookup table. The processor 316 can, in turn, forward a suitable indication of the user-adjustable control 206 to a dimmable light, for example, through a suitable communications link, such as a power line communications link.

It is worth noting that the voltage seen at the microcontroller input node will be VCC divided between the three resistances in the circuit proportionally. This means that unless resistor R7 is significantly larger than the highest value of the potentiometer added to resistor R2 this signal may not be suitable as a digital input. Resistor R7 can be chosen to accommodate this, but depending on the value of C1, it may cause excessive delays in discharging the capacitor if resistor R2 or potentiometer R3 are large in value. In order to address such situations, an amplifier can be added to the output to scale the divided voltage to an appropriate digital level. Alternatively or in addition, a comparator can be used to compare the voltage against the center point of its divided range.

Figure 8:
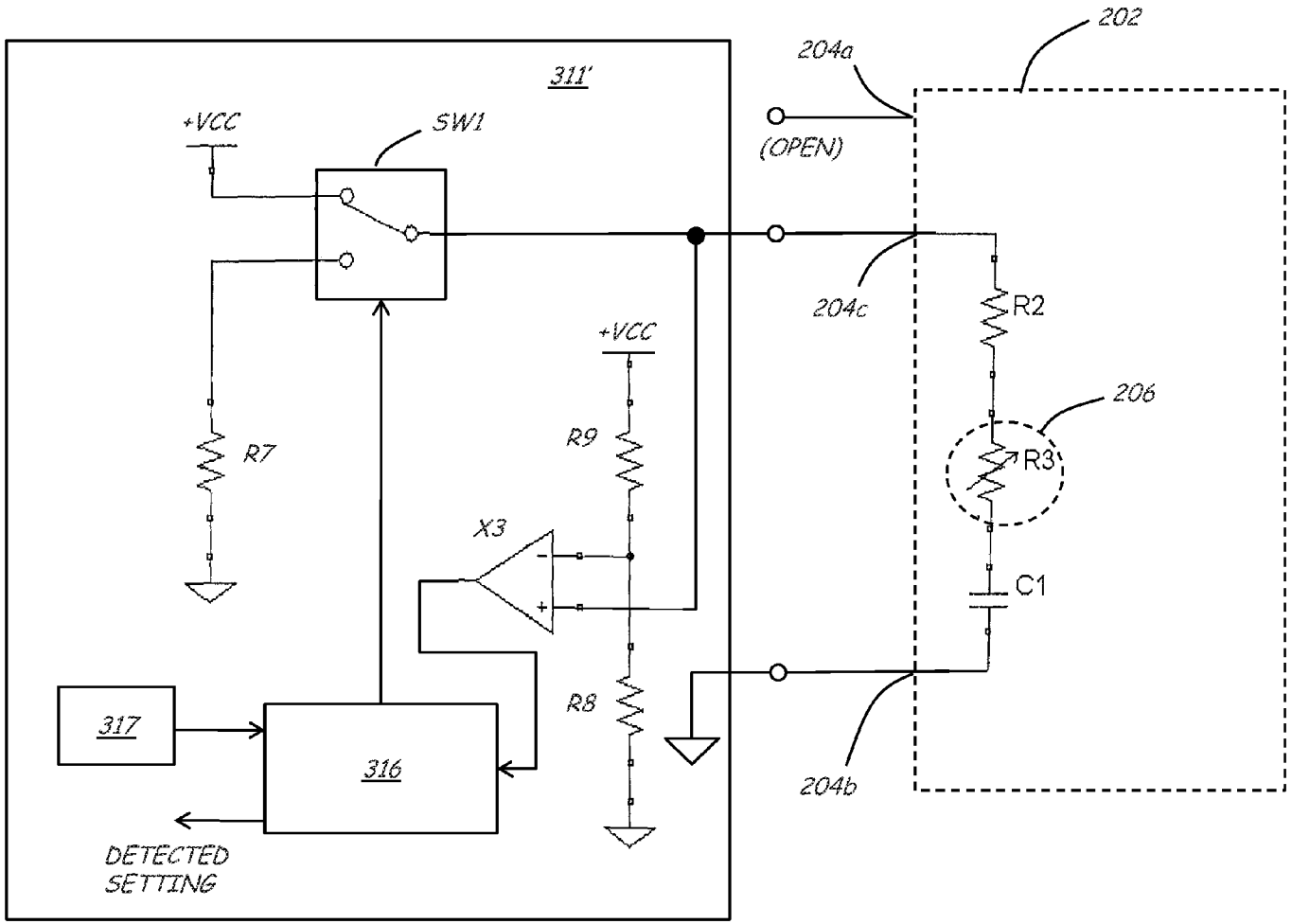
FIG. 8 is a more detailed circuit diagram of an embodiment of the detector illustrated in FIG. 7.

FIG. 8 illustrates another ELV dimmer adapter 311', in which the detector 314 of the previous embodiment is implemented by a comparator X3 configured to compare a discharge voltage measured at terminal 204*c* to a fixed reference value $V_{REF}$. The reference value $V_{REF}$ is determined by the biasing network of resistors R8 and R9, driven by a suitable DC voltage VCC. In the illustrative example, the reference value is determined by the product of VCC and the value R8/(R8+R9).

If the switch SW1 can be switched at a fixed frequency, such that the measurement can become a duty cycle or percentage of the period for which the output is at a high digital output. These types of outputs may be sensed by a microcontroller (e.g., processor 316) as well. Care must be taken to ensure the period is long enough for full charge and discharge of the capacitor.

In the above description and appended drawings, it is to be appreciated that only the terms "consisting of" and "consisting only of" are to be construed in the limitative sense while of all other terms are to be construed as being open-ended and given the broadest possible meaning.

Since certain changes may be made in the above described improved system for sensing the position of a ELV dimmer, without departing from the spirit and scope of the invention herein involved, it is intended that all of the subject matter of the above description or shown in the accompanying drawings shall be interpreted merely as examples illustrating the inventive concept herein and shall not be construed as limiting the invention. Additionally, although the illustrative examples describe varying intensity or otherwise dimming lighting sources, it is understood that the techniques described herein can be used to vary other lighting source attributes, such as color, scene, color temperature, and the like.

Since certain changes may be made in the above described high power light emitting diode (LED) lighting unit for indoor and outdoor lighting functions, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Further, the invention has been described with reference to particular preferred embodiments, but variations within the spirit and scope of the invention will occur to those skilled in the art. For example, although the various examples provided herein relate to dimming light sources, similar devices and techniques can be used for the control of any suitable electrical device, such as electric motors (e.g., fans) or as may be advantageous in other aspects of industrial process control. It is noted that the foregoing examples have been provided merely for the purpose of explanation and are in no way to be construed as limiting of the present invention.

While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

We claim:

1. A method for dimming a light, comprising:

applying an electrical stimulus at one or more of a first and second externally accessible terminals of a trailing edge dimming/reverse phase control ELV dimmer device, the dimmer device having a variable resistor as a user-adjustable control settable between low and high dimmer settings;

replacing the electrical stimulus with a resistive load and measuring an electrical response at one or more of the first and second externally accessible terminals of the dimmer device, the electrical response being responsive to the applied electrical stimulus and a setting of the user-adjustable control;

determining from the measured electrical response an indication of the setting of the user-adjustable control; and dimming a light source responsive to the determined dimmer device setting.

2. The method of claim 1, wherein the electrical stimulus is a non-modulated dc voltage.

3. The method of claim 2, further comprising applying a dc offset to the electrical response, the measured electrical response including the applied dc offset.

4. The method of claim 2, wherein detecting the electrical response comprises low-pass filtering the electrical response.

5. The method of claim 1, wherein applying the electrical stimulus comprises:

applying a dc voltage to substantially fully charge an internal capacitive load of the dimmer device;

subsequently replacing the applied dc voltage with a resistive load, the resistive load discharging the internal capacitive load of the dimmer device until the internal capacitive load is substantially discharged; and measuring a time between replacement of the applied dc voltage with the resistive load and discharge of the capacitive load.

6. A method for determining a setting value of a trailing edge dimming/reverse phase control user-adjustable ELV dimmer, comprising:

applying an electrical stimulus to an externally accessible terminal of the ELV dimmer, the ELV dimmer having a variable resistor as a user-adjustable control input settable between low and high dimmer settings;

replacing the electrical stimulus with a resistive load and measuring an electrical response at a second externally accessible terminal of the ELV dimmer, the electrical response being responsive to the electrical stimulus and a setting of the user-adjustable control;

determining from the measured electrical response an indication of the setting of the user-adjustable control.

7. The method of claim 6, wherein the electrical stimulus is a non-modulated dc voltage.

8. The method of claim 7, further comprising applying a dc offset to the electrical response, the measured electrical response including the applied dc offset.

9. The method of claim 7, wherein detecting the electrical response comprises low-pass filtering the electrical response.

10. The method of claim 6, wherein applying the electrical stimulus comprises:

applying a dc voltage to substantially fully charge an internal capacitive load of the ELV dimmer;

subsequently replacing the applied dc voltage with a resistive load, the resistive load discharging the internal capacitive load of the ELV dimmer until the internal capacitive load is substantially discharged; and measuring a time between replacement of the applied dc voltage with the resistive load and discharge of the capacitive load.

11. A system for dimming a light, comprising:

an electrical power converter adapted for converting an AC line voltage to a non-modulated dc preferred electrical stimulus suitable for driving at least one externally accessible terminal of a trailing edge dimming/reverse phase control ELV dimmer control device having a variable resistor as a user-adjustable control input settable between low and high dimmer settings;

an electrical signal detector adapted for measuring at an externally accessible terminal of the dimmer control device, an electrical response of the dimmer control device after replacing the preferred electrical stimulus with a resistive load, the electrical response being indicative of a setting of the user adjustable control input; and a signal converter in electrical communication with the electrical signal detector, the signal converter adapted for converting the measured electrical response to a dimmer control signal indicative of the setting of the user adjustable control input.

12. The system of claim 11, further comprising a solid state light source in communication with the signal converter, the solid state light source being dimmable in response to the dimmer control signal.

13. The system of claim 12, wherein the solid state light source comprises at least one light emitting diode (LED).

14. The system of claim 11, wherein the electrical signal detector comprises a resistive network in electrical communication between the at least one externally accessible terminal and the signal converter.

15. The system of claim 14, further comprising a low pass filter in electrical communication between the at least one externally accessible terminal and the signal converter.

16. The system of claim 11, wherein the electrical signal detector comprises a resistive load and a switch in electrical communication between the electrical power converter, the resistive load and the at least one externally accessible terminal of the dimmer control device, the switch configured to selectively connect one of the resistive load and the electrical power converter to the at least one externally accessible terminal of the dimmer control device.

17. The system of claim 16, further comprising:

a timing reference; and a processor in communication with the electrical signal detector, the switch and the timing reference.

18. The system of claim 11, further comprising:

an adjustable power supply in communication with the signal converter, the adjustable power supply configured to provide an output drive current responsive to the dimmer control signal; and a solid-state light source in electrical communication with the adjustable power supply, the solid-state light source providing a variable output illumination responsive to the output drive current.

19. The system of claim 18, further comprising a communications link between the signal converter and the adjustable power supply.

20. The system of claim 19, wherein the communications link comprises a power line communications link.

21. The system of claim 19, further comprising a communications link between the signal converter and the adjustable power supply.

22. A system for detecting a setting of a line voltage dimmable controller, comprising:

means for applying an electrical stimulus at a first externally accessible terminal of a trailing edge dimming/reverse phase control ELV dimmer device, the dimmer device having a variable resistor as a user-adjustable control settable between low and high dimmer settings;

means for replacing the electrical stimulus with a resistive load and measuring an electrical response at a second externally accessible terminal of the dimmer device, the electrical response being responsive to the applied electrical stimulus and a setting of the user-adjustable control;

means for determining from the measured electrical response an indication of the setting of the user-adjustable control; and means for dimming a light source responsive to the determined dimmer device setting.

23. The method of claim 1, wherein the variable resistor is coupled in series between a resistor and capacitor internal to the conventional ELV dimmer device.

24. The method of claim 23, wherein the resistor is coupled in series to the first externally accessible terminals of the conventional ELV dimmer device and the capacitor is coupled in series to the second externally accessible terminals of the conventional ELV dimmer device.

25. The system of claim 11, wherein the variable resistor is coupled in series between a resistor and capacitor internal to the conventional ELV dimmer device.

26. The system of claim 25, wherein the resistor is coupled in series to the at least one externally accessible terminals of the conventional ELV dimmer device and the capacitor is coupled in series to the at least another externally accessible terminals of the conventional ELV dimmer device.

* * * * *